United States Patent [19]

Bartel et al.

[11] 4,072,350

[45] Feb. 7, 1978

[54] MULTI-STAGE METHOD OF OPERATING AN IN SITU OIL SHALE RETORT

[75] Inventors: William J. Bartel; Robert S. Burton, III, both of Grand Junction, Colo.

[73] Assignee: Occidental Oil Shale, Inc., Grand Junction, Colo.

[21] Appl. No.: 762,848

[22] Filed: Jan. 27, 1977

Related U.S. Application Data

[63] Continuation-in-part of Ser. No. 656,391, Feb. 9, 1976, abandoned, which is a continuation of Ser. No. 538,096, Jan. 2, 1975, abandoned.

[51] Int. Cl.[2] ..... E21B 43/26; E21C 41/10

[52] U.S. Cl. ..... 299/2; 166/245; 166/259

[58] Field of Search ..... 299/2; 166/245, 256, 166/258, 259

[56] References Cited

U.S. PATENT DOCUMENTS

| | | | |
|---|---|---|---|
| 2,481,051 | 9/1949 | Uren | 299/2 |
| 3,490,529 | 1/1970 | Parker | 166/256 |
| 3,499,489 | 3/1970 | Parker | 166/258 |
| 3,601,193 | 8/1971 | Grady | 166/245 |
| 3,661,423 | 5/1972 | Garrett | 299/2 |
| 3,692,110 | 9/1972 | Grady | 166/245 |

*Primary Examiner*—Ernest R. Purser
*Attorney, Agent, or Firm*—Christie, Parker & Hale

[57] ABSTRACT

A method of processing oil shale in which an in situ oil shale retort comprising an elongated cavity containing a fragmented permeable mass of formation particles containing oil shale is formed in a subterranean formation containing oil shale to recover liquid and gaseous products. Access to the cavity is by a drift or conduit at each end of the cavity and through a drift at an intermediate position. A processing zone is established in the fragmented mass at one end of the cavity and processing gas is introduced at that end of the retort and heating of the fragmented mass of formation particles is conducted from that end towards the other end. Initially, off gas is withdrawn at the intermediate drift. When the processing zone passes the intermediate drift, processing gas is introduced through the intermediate drift and off gas including gaseous products is withdrawn by way of the drift at the other end. As the processing zone passes the intermediate drift, processing gas is introduced at one end and off gas is withdrawn from the other end of the retort.

28 Claims, 1 Drawing Figure

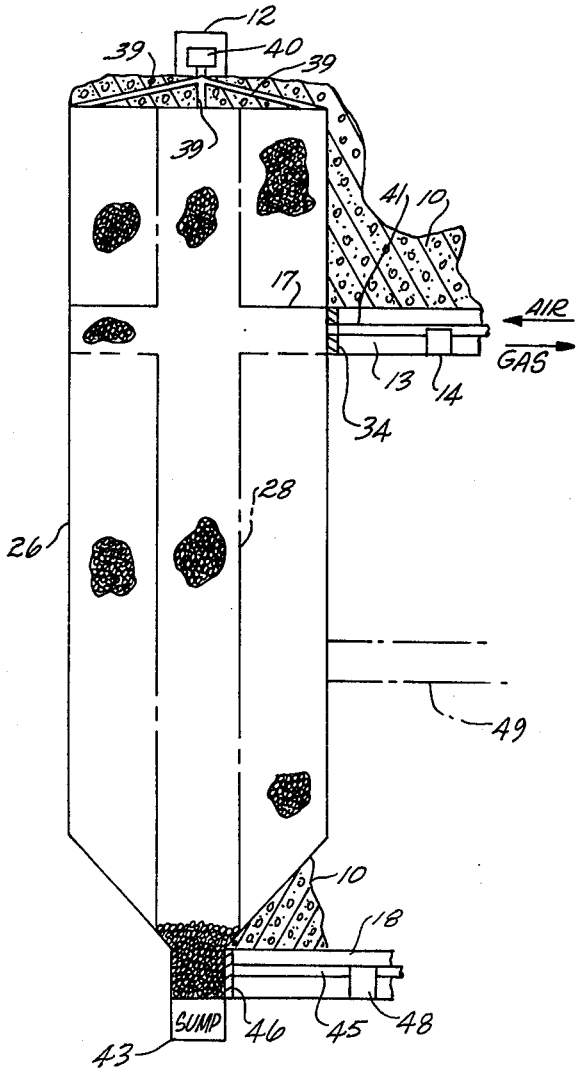
12
40
39
39
39
41
10
17
AIR
GAS
13
14
34
28
26
49
10
18
SUMP
46
45
48
43

MULTI-STAGE METHOD OF OPERATING AN IN SITU OIL SHALE RETORT

CROSS-REFERENCES

This application is a continuation-in-part of co-pending patent application Ser. No. 656,391, filed on Feb. 9, 1976, and now abandoned which is a continuation of patent application Ser. No. 538,096, filed on Jan. 2, 1975, and now abandoned.

BACKGROUND OF THE INVENTION

This invention relates to in situ processing of oil shale, and more particularly, to a method of processing in stages to increase efficiency.

In co-pending application Ser. No. 716,538, filed Aug. 23, 1976, by Gordon French entitled "Method for In Situ Recovery of Liquid and Gaseous Products from Oil Shale Deposits," assigned to the same assignee as the present invention, and incorporated herein by reference, there is described a multi-level technique by which a vertical in situ oil shale retort is formed in a subterranean formation containing oil shale by mining in the formation a tunnel or drift at the top and a tunnel or drift at the bottom of the desired vertical extent of the retort. An intermediate room having horizontal dimensions corresponding approximately to the horizontal cross section of the retort being formed is also mined or excavated in the portion of the formation to become the in situ retort through an intermediate access tunnel or drift. A vertical columnar void is then formed in the middle of the volume of formation to become the in situ retort, and surrounding formation within the desired retort volume is explosively expanded by blasting to form a retort comprising a cavity containing a rubble pile comprising a fragmented permeable mass of formation particles containing oil shale. Other techniques can be used for forming an in situ oil shale retort containing a fragmented permeable mass of particles.

Once the retort is thus formed in situ, the fragmented mass of formation particles is ignited at the top of the retort to establish a combustion zone in the retort. A combustion supporting inlet gas comprising oxygen is introduced into the combustion zone to advance the combustion zone downwardly through the fragmented mass in the retort. In the combustion zone oxygen in the gas is depleted by reaction with hot carbonaceous materials to produce heat and combustion gas. By continued introduction of the combustion supporting gas into the combustion zone, the combustion zone is advanced through the retort. An effluent gas from the combustion zone, comprising combustion gas, gas from mineral carbonate decomposition and the portion of the inlet gas that does not take part in the combustion process, passes through the retort on the advancing side of the combustion zone to heat the oil shale in a retorting zone to a temperature sufficient to produce kerogen decomposition, called retorting, in the oil shale to gaseous and liquid hydrocarbon products.

As used herein, the term "processing gas" is used to indicate gas which serves to advance a processing zone such as a combustion zone, a retorting zone, or both a retorting zone and combustion zone, through the fragmented mass in an in situ oil shale retort, and includes, but is not limited to, an oxygen supplying gas introduced into a retort for advancing a combustion zone and retorting zone through a retort and a hot retorting gas which can be introduced into a retort or generated in a combustion zone in a retort for advancing a retorting zone through a retort.

The liquid hydrocarbon products and gaseous hydrocarbon products are cooled by the cooler oil shale particles in the retort on the advancing side of the retorting zone. The liquid products are collected at the bottom of the retort and withdrawn to the surface. An off gas or flue gas containing combustion gas generated in the combustion zone, gas from decomposition of mineral carbonates, gaseous products produced in the retorting zone, and the portion of the inlet gas that does not take part in the combustion process is also withdrawn from the bottom of the retort.

For maximum efficiency of operation, it is desirable to move large volumes of processing gas into the retort and corresponding large volumes of off gas from the retort with minimum expenditure of energy. The large vertical extent of the retort, which may be in the order of 200 or 300 feet, even though containing a permeable mass of formation particles having a void fraction in the order of 15% or more, nevertheless affords a substantial resistance to gas flow, particularly if the explosive expansion operation has not provided complete fragmentation of the formation within the cavity. As a result, excessive pressure drop can be developed to obtain a desired flow rate of gas, thereby requiring substantial expenditure of energy in moving gas through the retort with a resultant drop in overall economics of operation of the retort and recovery of shale oil.

For a given void fraction in the fragmented mass pressure drop in the retort increases as longer retorts are operated. It is desirable to employ long retorts in an effort to recover shale oil from the maximum extent of the formation containing oil shale. If the pressure difference required to obtain adequate gas flow rate is excessive, the energy required for pumps or blowers can be excessive. Further, high pressures can cause leakage of gas from the retort with consequent loss of efficiency. It is, therefore, desirable to keep the pressure difference across the length of the retort as low as possible for adequate flow and also to keep the maximum retort pressure low.

SUMMARY OF THE INVENTION

The present invention is directed to a method of processing oil shale in an in situ oil shale retort containing a fragmented permeable mass of particles containing oil shale in a subterranean formation containing oil shale, where the retort comprises a cavity having a gas inlet, a gas outlet, and at least one intermediate access to the cavity between the gas inlet and gas outlet. During a first stage of processing, a processing gas is introduced to a processing zone in the fragmented mass through the gas inlet and an off gas is withdrawn from the cavity at an intermediate access downstream from the processing zone. As the processing zone is advanced along the length of the retort by flowing gas, liquid products produced during the first stage of processing are recovered at the downstream end of the cavity.

After the processing zone passes the intermediate access where off gas is withdrawn during the first stage of processing, a subsequent stage of processing is commenced. In this subsequent stage, a processing gas is introduced to the processing zone through the intermediate access upstream from the processing zone and off gas is withdrawn from the cavity through the gas outlet. By processing oil shale in the retort in two or more such stages, good efficiency of processing results and resistance to gas flow is substantially reduced, thereby minimizing the energy used carrying out the processing operation.

During an intermediate stage between the first and subsequent stages of processing, processing gas is introduced through the gas inlet and off gas is withdrawn from the gas outlet.

DESCRIPTION OF THE DRAWINGS

For a better understanding of the invention, reference should be made to the accompanying drawing, wherein the single FIGURE is a semi-schematic vertical cross-sectional view of a retort which is operated according to principles of the present invention.

DESCRIPTION

Referring to the drawing, the numeral 10 indicates generally a subterranean formation containing oil shale. Such a formation may be hundreds of feet below the ground surface. An upper level drift, adit, tunnel 12, or the like is mined or otherwise formed at a level in or above an upper portion of the oil shale formation. An intermediate level drift or tunnel 13 is mined or otherwise formed at an intermediate elevation in the formation 10, the intermediate level drift 13 terminating in an excavated void, room or chamber 17 which has a horizontal cross section which corresponds to the desired cross section of the retort being formed.

A lower level tunnel or drift 18 is provided at a lower portion of the formation, or even beneath the oil shale rich portions of the formation. A vertical shaft or raise 28 or other columnar void is formed which extends from the end of the drift 18 vertically upward though the chamber 17 to a level immediately below the drift 12. The volume of the room 17 and columnar void 28 collectively are a fraction of the volume of formation to become the retort corresponding to the desired void fraction of the fragmented permeable mass of formation particles in the retort. Thus, for example, if the retort is to contain a fragmented permeable mass of formation particles having a an average void fraction of 15%, the volume of the room and raise total 15% of the final volume to become the retort. As described in the above-identified application, explosive is placed in the volume of formation to become the retort surrounding the raise. This is used to explosively expand the formation in a concentric zone about the raise 28 to form a retort comprising a cavity 26 containing a fragmented permeable mass of formation particles containing oil shale. Because the void space of the room and raise is then distributed between the particles of the fragmented mass of formation, the mass of particles substantially fills the entire cavity. Other techniques can be used to form an in situ oil shale retort comprising a cavity containing a fragmented permeable mass of formation particles containing oil shale in a subterranean formation.

After the explosive expansion of formation, a plurality of gas supply conduits or openings 39 are drilled from the upper level drift 12 to distribution points at the top of the retort. Air or other processing gas is conveyed from a suitable blower or pump 40 to the gas supply conduits 39. A conduit 41 in the intermediate level drift 13 extends through a bulkhead 34 into communication with an intermediate portion of the retort (the chamber 17 having been filled with fragmented formation particles formed in the blasting process). Initially, the conduit 41 at the intermediate level is used to exhaust flue gas or off gas from the retort.

A blower 14 is preferably connected to the conduit 41 in the intermediate drift and can be used to help withdraw off gas from the retort during this first stage of operation while processing gas is being introduced at the upper end of the retort. The blower 14 can also be connected to supply air or other processing gas to the retort in a second stage of operation hereinafter described.

The top of the mass of formation particles is ignited by initially mixing a combustible gas or other fuel with air admitted through the gas supply openings 39 to form a flame for igniting carbonaceous material in oil shale in the mass of particles. Once oil shale is ignited and a combustion zone is established, the combustible gas is discontinued and only a combustion supporting processing gas is introduced through the gas supply openings 39. A combustion supporting processing gas, which contains oxygen, can be air directly from the atmosphere, air mixed with recycled off gas or other combustible gas, or with inert gas or water vapor so as to have a reduced oxygen content, or air enriched with oxygen. Also, the processing gas can be substantially oxygen-free, and the processing gas can be added as hot gas to the retort for retorting the oil shale, or can be added as cool gas for transferring existing heat from hotter to cooler formation particles along the length of the retort. When the processing gas is oxygen-free, there is no combustion zone in the retort. The economics obtained by multiple stage operation of the retort as herein described are not governed solely by the nature of the processing gas, but a gas containing oxygen is the preferred processing gas for most in situ retorting, and the most preferred processing gas is a mixture of air and water vapor.

The heat of combustion of oxygen with carbonaceous material in the oil shale provides heat which is transferred by gas flow to heat the formation particles downstream of the combustion zone. This heating decomposes kerogen in the oil shale and drives off liquid and gaseous hydrocarbons as products from the oil shale. The zone being heated below the combustion zone is known as a retorting zone and is the principal region in which kerogen is decomposed to produce useful shale oil. Heating of the particles to establish a retorting zone can also be provided by passing hot inert gas through the retort. Similarly, once a sufficient mass of formation particles has been heated above the retorting temperature (about 700° to 1000° F), the heat can be transferred along the length of the retort for appreciable distances by flow of processing gas without adding heat of combustion. Thus, a processing zone comprising a combustion zone and a retorting zone is gradually moved along the length of the in situ retort by flowing processing gas introduced on one side of the processing zone and off gas withdrawn on the opposite side. During the first stage of the processing operation, an off gas including gaseous hydrocarbon product is removed through the conduit 41 in the intermediate level drift 13 while the liquid hydrocarbon products and water percolate to the bottom of the retort and are collected in a sump 43. It is a principal purpose of operation of the retort to recover these liquid hydrocarbon products as shale oil.

when the processing zone advances to the level of the intermediate drift 13, flow through the conduit 41 is terminated and off gas is withdrawn through a conduit 45 at the bottom of the cavity. A pump or blower 48 is preferably connected to the conduit 45 at the bottom of the retort to assist in withdrawing off gas. Thus, in this transition stage of the processing operation, processing gas flows in one end of the retort and off gas flows out the other end of the retort. After the processing zone has passed the level of the intermediate drift 13, flow of processing gas through the gas supply conduits 39 at the top is terminated and processing gas is introduced through the conduit 41 at the intermediate level. Off gas is withdrawn at the bottom end of the retort through the conduit 45. This provides a second stage of operation of the retort with processing gas being introduced at the intermediate portion of the retort and off gas being withdrawn from the bottom of the retort. This mode of operation can be continued until processing is completed.

When formation in the retort volume is blasted to form a fragmented mass of formation particles in the cavity, there can be some non-uniformity of void volume distribution because of the room or void 17. Formation adjacent the room at the intermediate level can move radially inwardly towards the center raise 28 or can move longitudinally inwardly towards the void 17 to fill it with oil shale formation particles. This can result in a somewhat higher average void volume or void fraction in this region of the mass of formation particles than in portions of the retort remote from the intermediate level drift. This is advantageous since the higher void fraction permits better processing or off gas distribution across the full width of the retort than if the void fraction were rather low. This minimizes disturbance of the shape of the processing zone which is preferably nearly planar.

If desired, another intermediate access can be provided to the retort by way of a drift 49 illustrated in phantom in the drawing. In such an embodiment, processing gas can be introduced through the upper intermediate drift 13 during the second stage of processing and off gas withdrawn from the lower intermediate drift 49. Thereafter, processing gas can be introduced through the lower intermediate drift 49 and off gas withdrawn through the bottom of the retort. Any number of desired intermediate levels of access to the retort can be provided as desired. Processing gas is introduced and off gas withdrawn through an adjacent pair of access means during the principal stages of retorting. During the transition operation while the processing zone passes one of the access means, processing gas can be introduced and off gas withdrawn through the two access means adjacent thereto to avoid disturbing the shape of the processing zone, which is preferably maintained substantially planar and transverse to the principal length of the retort.

By operating the retort in a series of stages where gas is passed through less than the full length of the retort, the flow resistance or pressure drop is minimized and the energy required for pumping gas through the retort is also minimized. During each stage of operation the gas is passed through a portion of the length of the retort in a downstream direction from the previous portion.

The method provided in practice of this invention is particularly advantageous in in situ retorts formed by explosive expansion where the mass of formation particles remains in place with a low void fraction. Thus, for example, in one embodiment the fragmented mass in the retort has an average void fraction of only about 15%. This is much lower than can be obtained in an in situ retort where a cavity is formed and subsequently filled with formation fragments. This low void fraction presents a greater resistance to gas flow than does such a retort filled after the cavity is formed. This method is, therefore, preferred for operating a retort having a void fraction in a range of from about 10 to about 25% of the total retort volume.

It will also be apparent that advantages of this invention can be achieved in an in situ oil shale retort that is not vertical as in the preferred embodiment. Many formations containing oil shale are essentially horizontal, and vertical retorts are preferred in that situation. When the formation has an appreciable dip, the principal length of the retort may extend at an angle to vertical. Use of plural access means to the retort cavity for introducing processing gas and with drawing off gas in several stages along the length of the retort can also be useful in a retort where the direction of gas flow is essentially horizontal. It is preferred that the flow of gas through the retort be downward for enhanced yield of liquid hydrocarbon products.

The following is an illustrative example of a method of operating an in situ oil shale retort of the kind described above and shown in the drawing, having access means in fluid communication with a portion of the fragmented permeable mass of formation particles intermediate the top and bottom of the retort.

A combustible gas and air mixture introduced into the top of the retort is ignited by means known in the art, as, for example, described in copending application Ser. No. 492,593, entitled "Method for Igniting Oil Shale Retort," filed on July 26, 1974 by Robert S. Burton III, now U.S. Pat. No. 3,952,801 and U.S. Pat. No. 3,990,835 entitled "Burner for Igniting Oil Shale Retort," issued on Nov. 9, 1976 to Robert S. Burton III, and both assigned to the same assignee as the present application. After ignition of oil shale, the flow of the gas and air mixture is discontinued and retorting proceeds with the introduction of a flow of air through the gas supply conduits 39 at the top of the retort. In the first stage of operation, off gas is withdrawn through the side conduit 41 in the intermediate level tunnel 13 during a first period of time. Shale oil produced during retorting trickles down through the fragmented mass of particles to the sump in the oil collection system at the bottom of the retort from where it is withdrawn to storage.

When the processing zone comprising a combustion zone and a retorting zone comes near the side conduit, the side conduit is closed and for a second period of time, air is admitted through the upper gas supply conduits 39 and off gas is withdrawn through conduit means 45 at the bottom of the retort. The approach of the processing zone to the intermediate level tunnel 13 is sensed by an increase in the temperature of the off gas exiting from the side conduit 41, or by thermocouples placed in the retort near the side conduit.

After the processing zone has passed the side conduit, it is reopened and air is introduced therethrough for a third period of time. The introduction of air through the gas supply inlets 39 at the top is discontinued when desired, as when it is not desired to heat incoming air or other retorting fluid by passing it through the hot retorted shale above the side conduit 41. When the combustion zone has moved downwardly below the side conduit 41 at a distance of about 20 feet, in this case, the introduction of air at the top through the gas supply inlets 39 is discontinued. It is found in this case that the pressure drop between top and bottom of the retort is about 4 psig, whereas between the side conduit 41 and the bottom the pressure drop is about 2 psig. Therefore, the processing of oil shale by the method of this invention can be conducted with greater ease when air or other gases can be withdrawn or introduced through a conduit in the side of the retort, intermediate its ends. Also, shale oil is satisfactorily recovered from the oil shale in the retort.

Off gas can be withdrawn through both the side conduit 41 and the bottom conduit 45 during the processing of oil shale in the portion of the fragmented mass of particles in the retort which is above the side conduit 41. The introduction of gas through the gas supply conduits 39 at the top can be reduced or discontinued when air is admitted through the side conduit 41 or at any time thereafter. As described above, a plurality of access means can be provided along the side of a retort between its ends. Air or other processing gas can be introduced into the retort through one or more inlets upstream from the combustion zone, an off gas can be withdrawn through one or more outlets downstream of the combustion zone. Processing gas, with or without air, can be passed or recycled through the retort for the purpose of achieving processing of the oil shale.

Although preferred versions of the invention have been described herein, many modifications and variations are possible. Thus, for example, access can be approximately to the middle of the length of the retort cavity rather than relatively nearer the top as is the intermediate tunnel 13 in the illustrated embodiment. In such a case, approximately the top half of the retort is processed in the first stage of operation and the bottom half is processed in the second stage. Other techniques for forming the in situ retort can, of course, also be employed. Thus, it will be understood that this invention may be practiced otherwise than as specifically described.

What is claimed is:

1. A method of processing oil shale in an in situ oil shale retort in a subterranean formation containing oil shale, said in situ retort comprising a cavity having a gas inlet, a gas outlet, and at least one intermediate access to the cavity between the gas inlet and gas outlet and containing a fragmented permeable mass of particles containing oil shale, comprising the steps of:

establishing a processing zone in the in situ oil shale retort near the gas inlet;

during a first sate of processing introducing a processing gas to the processing zone through the gas inlet and withdrawing off gas from the cavity at such an intermediate access downstream from the processing zone for advancing the processing zone through a first portion of the fragmented mass; and thereafter during a subsequent stage of processing introducing a processing gas to the processing zone through an intermediate access upsteam from the processing zone and withdrawing off gas from the cavity through the gas outlet for advancing the processing zone through a second portion of the fragmented mass.

2. A method as defined in claim 1 wherein the retort has a single intermediate access through which gas is withdrawn during the first stage and gas is introduced during the subsequent stage, further comprising the step of introducing processing gas through the gas inlet and withdrawing off gas from the gas outlet between the first and subsequent stages of processing for advancing the processing zone through a portion of the fragmented mass near the intermediate access.

3. A method as defined in claim 2 wherein the principal length of the mass of particles containing oil shale being retorted extends in a generally vertical direction and wherein processing gas is introduced at the top of the mass during the first stage of processing and off gas is withdrawn from the bottom of the retort during the subsequent stage of processing.

4. A method as defined in claim 1 wherein the principal length of the mass of particles containing oil shale being retorted extends in a generally vertical direction and wherein processing gas is introduced at the top of the mass during the first stage of processing and off gas is withdrawn from the bottom of the retort during the subsequent stage of processing.

5. A method as defined in claim 4 further comprising the step of recovering liquid hydrocarbons produced during the first stage of processing at the bottom of the retort.

6. A method as defined in claim 1 wherein the processing zone comprises a combustion zone and a retorting zone, the processing gas comprises oxygen and the establishing and processing steps include the steps of:

igniting oil shale particles near the gas inlet to the retort for establishing the combusion zone; and transferring heat from the combustion zone to the retorting zone by flow of gas through at least a portion of the retort.

7. A method as defined in claim 6 wherein the retort has a single intermediate access through which gas is withdrawn during the first stage and gas is introduced during the subsequent stage further comprising the step of temporarily introducing processing gas through the gas inlet and withdrawing off gas from the gas outlet between the first and the subsequent stage of processing.

8. A method as defined in claim 7 wherein the retort has its principal length extending in a generally vertical direction and wherein processing gas is introduced at the top of the retort during the first stage of processing and off gas is withdrawn from the bottom of the retort during the subsequent stage of processing.

9. A method as defined in claim 1 wherein the retort has a plurality of intermediate accesses to the cavity between the gas inlet and the gas outlet further comprising the step of:

introducing processing gas to the processing zone through one intermediate access upstream from the processing zone and withdrawing off gas from the cavity through an intermediate access downstream from the processing zone during an intermediate stage of processing between the first stage of processing and the subsequent stage of processing.

10. A method as defined in claim 9 further comprising the step of temporarily introducing processing gas to the cavity either through the gas inlet or through an intermediate access upstream from the processing zone, and withdrawing off gas from the cavity either through the gas outlet or through an intermediate access downstream from the processing zone during a transition stage of processing while the processing zone passes one of the intermediate accesses.

11. In a method of processing oil shale in an in situ oil shale retort in a subterranean formation containing oil shale, said in situ retort being in the form of a cavity containing a fragmented permeable mass of formation particles containing oil shale wherein a processing gas is passed through the cavity for causing a processing zone to pass through the cavity, the improvement comprising:

passing the processing gas through only a first portion of the cavity during a first stage of operation of the retort;

passing the processing gas through only a second portion of the cavity during a later stage of operation of the retort, the second portion being in a downsteam direction from the first portion; and passing the processing gas through both the first and second portions during a transition operation between the first and the later stage of operation.

12. In a method as defined in claim 11 wherein the processing zone comprises a combustion zone and a retorting zone, the processing gas comprises oxygen, the further steps of:

igniting oil shale particles at the upstream end of the retort for establishing the combustion zone; and transferring heat from the combustion zone to the retorting zone by flow of gas through at least a portion of the cavity.

13. A method as defined in claim 12 further comprising the step of recovering liquid hydrocarbons produced during the first stage of operation at the downstream end of the cavity.

14. In a method of operating an elongated, vertically extending in situ oil shale retort in a subterranean formation containing oil shale, said retort being in the form of a subterranean cavity containing a fragmented permeable mass of formation particles containing oil shale, by heating the mass of particles in the in situ oil shale retort to form a processing zone and advancing the processing zone downwardly through the in situ oil shale retort, the improvement comprising:

initially introducing processing gas at an upper portion of the cavity and withdrawing off gas from an intermediate portion between the top and the bottom of the cavity while the processing zone is between the upper portion and the intermediate portion;

temporarily introducing processing gas at the upper portion of the cavity and withdrawing off gas from the lower portion of the cavity while the processing zone is in the intermediate portion; and thereafter introducing processing gas at the intermediate portion and withdrawing off gas from a lower portion of the cavity while the processing zone is between the intermediate portion and the lower portion.

15. In a method as defined in claim 14, the improvement wherein the upper portion is at the top of the cavity, the lower portion is at the bottom of the cavity and the intermediate portion is at an elevation between the top and the bottom and further comprising the step of removing liquid products from the bottom of the cavity.

16. A method of in situ retorting of oil shale comprising:

forming a vertically elongated cavity in a subterranean formation containing oil shale, the cavity containing a fragmented permeable mass of formation particles containing oil shale, the mass of particles having an average void fraction in the order of about 15%, igniting the top of the mass of formation particles to form a combustion zone, introducing a combustion supporting gas into the top of the cavity and withdrawing off gas from the cavity at an intermediate elevation for moving the combustion zone downwardly through an upper portion of the mass of formation particles in the cavity, and thereafter introducing combustion supporting gas into the cavity at the intermediate elevation after the combustion zone passes the intermediate elevation and withdrawing off gas from the cavity at a lower elevation for moving the combustion zone downwardly through a lower portion of the mass of formation particles in the cavity.

17. A method as defined in claim 16 comprising the additional step of introducing combustion supporting gas into the top of the cavity and withdrawing off gas from the cavity at the lower elevation for moving the combustion zone downwardly through an intermediate portion of the mass of formation particles at the intermediate elevation.

18. An in situ oil shale retort in a subterranean formation containing oil shale comprising:

a cavity containing a fragmented permeable mass of formation particles containing oil shale having a predetermined average void fraction, an intermediate portion of the mass of formation particles between the ends of the cavity having a void fraction greater than the predetermined average void fraction;

means for introducing processing gas at one end of the cavity;

means for withdrawing off gas from the other end of the cavity; and means in fluid communication with the intermediate portion of the mass of formation particles having greater than average void fraction for alternatively withdrawing off gas from the intermediate portion and introducing processing gas to the intermediate portion.

19. An in situ oil shale retort as defined in claim 18 wherein:

the means for introducing processing gas is at the top of a vertically extending retort;

the means for withdrawing off gas is at the bottom of the vertically extending retort; and the means for alternatively introducing processing gas and withdrawing off gas is at an elevation between the top and bottom of the vertically extending retort.

20. A method of processing oil shale in an in situ oil shale retort in a subterranean formation containing oil shale, said retort comprising a cavity containing a fragmented permeable mass of formation particles containing oil shale, comprising the steps of:

during a first stage of processing introducing a processing gas at one end of the retort and withdrawing off gas from an intermediate portion of the retort between its ends; and thereafter during a second stage of processing introducing a processing gas at an intermediate portion of the retort between its ends and withdrawing off gas from the other end; and wherein the retort has a single intermediate portion where off gas is withdrawn during the first stage and processing gas is introduced during the second stage; and further comprising the step of introducing processing gas at one end and withdrawing off gas from the other end between the first and second stages of processing.

21. A method of retorting oil shale in an in situ oil shale retort comprising the steps of:

forming an in situ oil shale retort comprising a cavity in the subterranean formation containing oil shale, the cavity containing a fragmented permeable mass of formation particles containing oil shale;

forming a gas inlet to the cavity;

forming a gas outlet from the cavity;

forming at least one intermediate access to the cavity between the gas inlet and the gas outlet;

establishing a processing zone in the mass of formation particles near the gas inlet;

introducing processing gas into the cavity through the gas inlet and withdrawing off gas from the cavity through an intermediate access during a first stage of processing for moving the processing zone through a first portion of the mass of formation particles between the gas inlet and the intermediate access; and introducing processing gas to the cavity through an intermediate access and withdrawing off gas from the cavity through the gas outlet during a later stage of processing following the first stage for moving the processing zone through another portion of the mass of formation particles.

22. A method as defined in claim 21 further comprising the step of:

introducing processing gas to the cavity at the gas inlet and withdrawing off gas from the gas outlet during an intermediate stage of processing between the first and the later stage for moving the processing zone through the portion of the mass of formation particles near the intermediate access.

23. A method as defined in claim 21 wherein the first forming step comprises forming a fragmented permeable mass of formation particles having a higher void fraction in the portion near the intermediate access than the average void fraction of the mass of formation particles.

24. A method as defined in claim 21 wherein the in situ oil shale retort is vertical with the gas inlet at the top, and the gas outlet at the bottom, and wherein the intermediate access comprises a drift to the cavity at an intermediate elevation between the top and bottom, and further comprising the step of recovering liquid products of the first and the later stage of operation from the bottom of the in situ oil shale retort.

25. A method as defined in claim 24 further comprising the step of:

introducing processing gas to the mass of formation particles at the top and withdrawing off gas from the bottom during an intermediate stage of processing between the first and the later stage for moving the processing zone through the portion of the mass of formation particles near the drift.

26. A method as defined in claim 24 wherein the first forming step comprises forming a fragmented permeable mass of formation particles having a higher void fraction in the portion near the drift than the average void fraction of the mass of formation particles.

27. A method as defined in claim 21 wherein the retort has a plurality of intermediate accesses to the cavity between the gas inlet and the gas outlet further comprising the step of:

introducing processing gas to the cavity through one intermediate access upstream from the processing zone and withdrawing off gas from the cavity through an intermediate access downstream from the processing zone during an intermediate stage of processing between the first stage of processing and the later stage of processing.

28. A method as defined in claim 27 further comprising the step of temporarily introducing a processing gas to the cavity either through the inlet or through an intermediate access upstream from the processing zone, and withdrawing off gas from the cavity either through the gas outlet or through an intermediate access downstream from the processing zone during a transition stage of processing while the processing zone passes one of the intermediate accesses.

* * * * *

UNITED STATES PATENT AND TRADEMARK OFFICE

CERTIFICATE OF CORRECTION

PATENT NO. : 4,072,350

DATED : February 7, 1978

INVENTOR(S) : William J. Bartel, Robert S. Burton, III

It is certified that error appears in the above-identified patent and that said Letters Patent are hereby corrected as shown below:

Column 1, line 16, "716,538" should be -- 716,583 --.

Column 4, line 29, "economics" should be -- economies --.

Column 7, line 47, "sate" should be -- stage --;

Column 7, line 55, "upsteam" should be -- upstream --.

Column 9, line 9, "downsteam" should be -- downstream --.

Column 12, line 33, after "the" and before "inlet" insert --gas--

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*